United States Patent [19]

Ruminsky et al.

[11] 4,417,452

[45] Nov. 29, 1983

[54] HEAT PUMP SYSTEM DEFROST CONTROL

[75] Inventors: Robert T. Ruminsky, Bloomington; Stephen L. Serber, New Hope, both of Minn.

[73] Assignee: Honeywell Inc., Minneapolis, Minn.

[21] Appl. No.: 278,942

[22] Filed: Jun. 30, 1981

Related U.S. Application Data

[62] Division of Ser. No. 109,743, Jan. 4, 1980, abandoned.

[51] Int. Cl.[3] ..... F25D 21/06

[52] U.S. Cl. ..... 62/155; 62/156; 62/234

[58] Field of Search ..... 62/155, 156, 234, 140, 62/176 A, 128; 165/17

[56] References Cited

U.S. PATENT DOCUMENTS 4,209,994 7/1980 Mueller et al. ..... 62/156

FOREIGN PATENT DOCUMENTS 54-6159 1/1979 Japan ..... 62/140

54-157360 12/1979 Japan ..... 62/234

*Primary Examiner*—Lloyd L. King
*Assistant Examiner*—Harry B. Tanner
*Attorney, Agent, or Firm*—Roger W. Jensen

[57] ABSTRACT

An outdoor coil defrost control system for a reverse cycle refrigeration system comprising outdoor air temperature sensing means, means for producing an output signal indicative of the operation of the refrigeration compression means, and a special controller means having operative connections to the temperature sensing means and compression sensing means and comprising in part (a) a special variable frequency oscillator having an input indicative of the outdoor air temperature and an output signal the frequency of which varies as a non-linear function of the magnitude of the outdoor air temperature, (b) a counter means having an input connected to receive the output signal of the variable frequency oscillator, and (c) means for placing said refrigeration system into an outdoor coil defrost mode of operation upon the counter means counting a preselected number of counts or pulses.

3 Claims, 7 Drawing Figures

HEAT PUMP SYSTEM DEFROST CONTROL

This is a division of application Ser. No. 109,743, filed Jan. 4, 1980, now abandoned.

BACKGROUND OF THE INVENTION

One of the well known problems associated with heat pumps is that the outdoor coils thereof will, under normal circumstances, have frost accumulate thereon during the heating mode of operation. As the frost thickness increases, then the overall efficiency of the system decreases significantly, and valuable energy is wasted. Accordingly, many schemes have heretofore been proposed for detecting the frost and for taking corrective action for removing the frost from the outdoor coil. Examples of prior art systems include U.S. Pat. Nos. 3,170,304; 3,170,305; and 3,400,553. Other prior art arrangements are disclosed in the co-pending applications of Dale A. Mueller and Stephen L. Serber, Ser. No. 954,141, filed Oct. 24, 1978, U.S. Pat. No. 4,209,994; and Ser. No. 109,742 filed Jan. 4, 1980, U.S. Pat. No. 4,302,947 Application Ser. No. 954,141 discloses an arrangement for using the temperature of the outdoor air to modify the timing function for activation of the defrost mode of operation. The other co-pending application discloses an arrangement for using the temperature of the outdoor coil to vary the duration of the heating interval prior to activation of the defrost mode of operation.

The present invention is an improvement over the arrangements disclosed in said co-pending applications in that it comprises a simplified controller; the controller comprises a variable frequency oscillator which is controlled to oscillate at a frequency which is a non-linear function of the outdoor temperature. The output from the oscillator is applied to a counter which is controlled as a function of the temperature of the outdoor coil; when the counter has attained a preselected number of counts then the defrost mode of operation is commanded. The non-linear function is matched to a preselected schedule of defrost cycles for the heat pump, said schedule in turn being a non-linear function of the temperature of the outdoor air. Alternatively, the variable frequency oscillator is controlled to oscillate at a frequency which is a non-linear function of the outdoor coil temperature.

SUMMARY OF THE INVENTION

The present invention is an outdoor coil defrost control system for a reverse cycle refrigeration system comprising the conventional refrigerant compression means, indoor coil, outdoor coil, and refrigerant conduit means interconnecting the compression means and the coils. More specifically the outdoor coil defrost system comprises outdoor air temperature sensing means having an output indicative of outdoor air temperature, outdoor coil temperature sensing means having an output indicative of the temperature of the outdoor coil, means for producing an output signal indicative of the operation of the compression means, and a special controller means. The special controller means has operative connections to the above recited temperature sensors and compression means operation sensor so as to receive the outputs thereof. The special controller comprises in part a special variable frequency oscillator having an input adapted to receive a signal indicative of the outdoor air temperature and an output signal the frequency of which varies as a non-linear function of the magnitude of the outdoor air temperature. The special controller further comprises a counter means having an input connected to receive the output signal of the variable frequency oscillator. Finally the special controller comprises means for placing said heat pump system into an outdoor coil defrost mode of operation upon the counter means counting a preselected number of counts or pulses.

Alternatively the outdoor coil defrost system comprises outdoor coil temperature sensing means having an output indicative of the temperature of the outdoor coil, means for producing an output signal indicative of the operation of the compression means, and a special controller means. The special controller means has operative connections to the outdoor coil temperature sensor and compression means operation sensor so as to receive the outputs thereof. The special controller comprises in part a special variable frequency oscillator having an input adapted to receive a signal indicative of the outdoor coil temperature and an output signal the frequency of which varies as a non-linear function of the magnitude of the outdoor coil temperature. The special controller further comprises a counter means having an input connected to receive the output signal of the variable frequency oscillator. Finally the special controller comprises means for placing said heat pump system into an outdoor coil defrost mode of operation upon the counter means counting a pre-selected number of counts or pulses.

DESCRIPTION OF THE PREFERRED EMBODIMENTS

Figure 1:
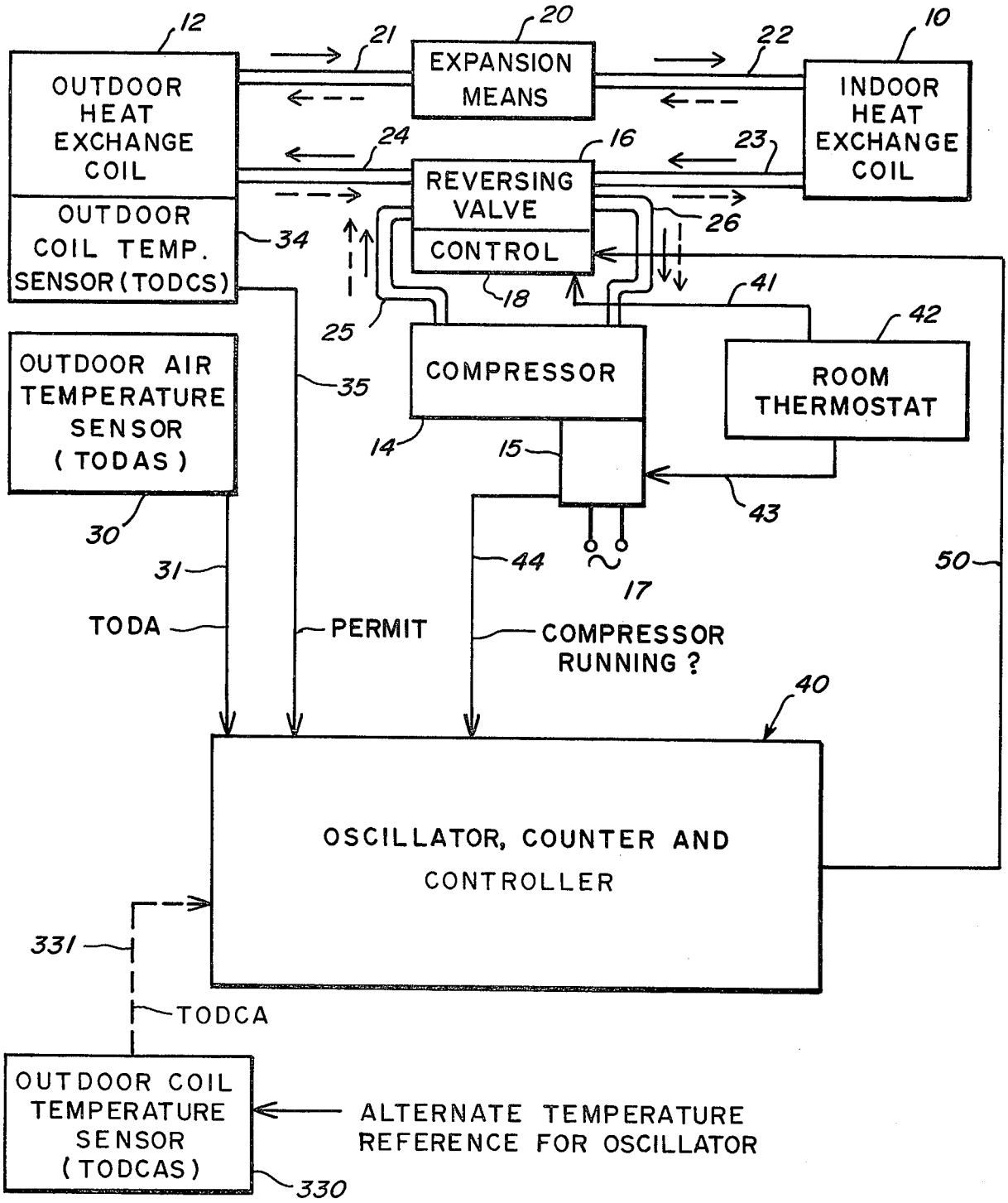
FIG. 1 is a block diagram of a reverse cycle refrigeration system which embodies the present inventions.

Referring to FIG. 1, the block diagram of the reverse cycle refrigeration system of the present invention comprises an indoor heat exchange coil 10, an outdoor heat exchange coil 12, a refrigerant compression means or compressor 14 and refrigerant conduit means interconnecting the coils and the compressor, the refrigerant conduit means including a reversing valve 16 having a control 18, and expansion means 20, and appropriate interconnecting piping 21–26. The system as thus far described is old in the art and is exemplified by the above identified patents and application. A brief description of the operation of the system is that during the indoor heating mode, i.e. when the reverse cycle system is operated so as to heat the inside of a building, then compressor 14 will discharge relatively hot gaseous refrigerant through pipe 25, reversing valve 16 and pipe 23 to the indoor heat exchange coil 10 through which heat is provided to the building. During the cooling mode, the reversing valve 16 is operated so that the hot gaseous refrigerant from the compressor is routed via pipe 26, reversing valve 16 and pipe 24 to the outdoor heat exchange coil.

The defrost control system comprises an outdoor air temperature sensing means 30 which will hereinafter sometimes be referred to as "TODAS" and which has an output 31 on which is available an output signal indicative of the outdoor air temperature and which is sometimes hereinafter referred to as "TODA." TODA output 31 is one of two temperature inputs to a special oscillator, counter and controller 40 to be described in more detail below. The defrost control system further comprises outdoor coil temperature sensing means 34 hereinafter sometimes referred to as "TODCS" having an output lead 35 which is symbolic of an output signal indicative of the temperature of the outdoor coil said signal sometimes hereinafter being referred to as "PERMIT."

Alternatively, TODAS 30 and the corresponding TODA output 31 may be replaced with an outdoor coil temperature sensing means 330 which will hereinafter sometimes be referred to as "TODCSA" and which has an output 31 on which is available an output signal indicative of the outdoor coil temperature and which is sometimes hereinafter referred to as "TODCA." TODCA output 331 replaces TODA output 31 as one of two temperature inputs to controller 40. TODCS and TODCSA may be the same sensor, with a means provided to supply TODCA and PERMIT as separate signals.

Compressor 14 is controlled by a controller 15 adapted to be energized from a suitable supply of electric power 17 and to be controlled from a rest "off" position to an operating or "on" condition as a function of receiving command signals from a suitable room thermostat 42 through interconnection means 43; the command signals as is well understood may be either a command for heating or cooling of the space being controlled by the heat pump. The reversing valve 16 is also controlled by a connection means 41 from thermostat 42 so as to be in the appropriate position for the commanded system mode of operation; i.e. heating or cooling. A connection 44 is provided between the controller 15 of the compressor 14 and the special controller 40; the purpose of connection 44 is to provide a signal to controller 40 indicative of whether or not the compressor 14 is running.

The special controller 40 has an output connection 50 which is connected to control 18 of the reversing valve 16 which, as explained above, controls the mode of operation of reverse cycle refrigeration system; more specifically an output from controller 40 via 50 can command the cooling mode of operation as the reverse cycle refrigeration system so as to cause the melting and dispersal of any frost on the outdoor coil 12 which may have accumulated during the prior heating mode of operation.

A suitable temperature sensor for TODAS 30 is resistance type temperature sensor model C800A manufactured by Honeywell Inc., Minneapolis, Minn. Honeywell Inc. model T872 thermostat may be used for the room thermostat 42, this thermostat being a bi-metal operated mercury switch for heating and cooling applications and further including switch means for controlling a plurality of auxiliary heating means.

Also, Honeywell Inc. model L4008C thermostat may be used for TODCS 34, this thermostat being a filled bulb operated switch for temperature sensing applications; a suitable temperature sensor for TODCAS 330 is resistance type temperature sensor model C800B manufactured by Honeywell Inc.; further the functions performed by TODCS 34 and TODCAS 330 may be performed with a single resistance type temperature sensor model C800B manufactured by Honeywell Inc., with suitable electronic circuitry to provide the appropriate signals TODC and TODCA. The room thermostat 42 may be the means for providing the signal applied to connection 44 indicating whether or not the compressor 14 is running. A suitable heat pump which may be used in combination with the present invention is a unit manufactured by the Westinghouse Company comprising an outdoor unit model No. HL036COW and indoor unit AG012HOK.

It will also be understood by those skilled in the art that the functional interconnections depicted in FIG. 1 are representative of one or more electrical wires or mechanical parts and or tubes, as the case may be, as dictated by the specific equipment shown.

Figure 2:
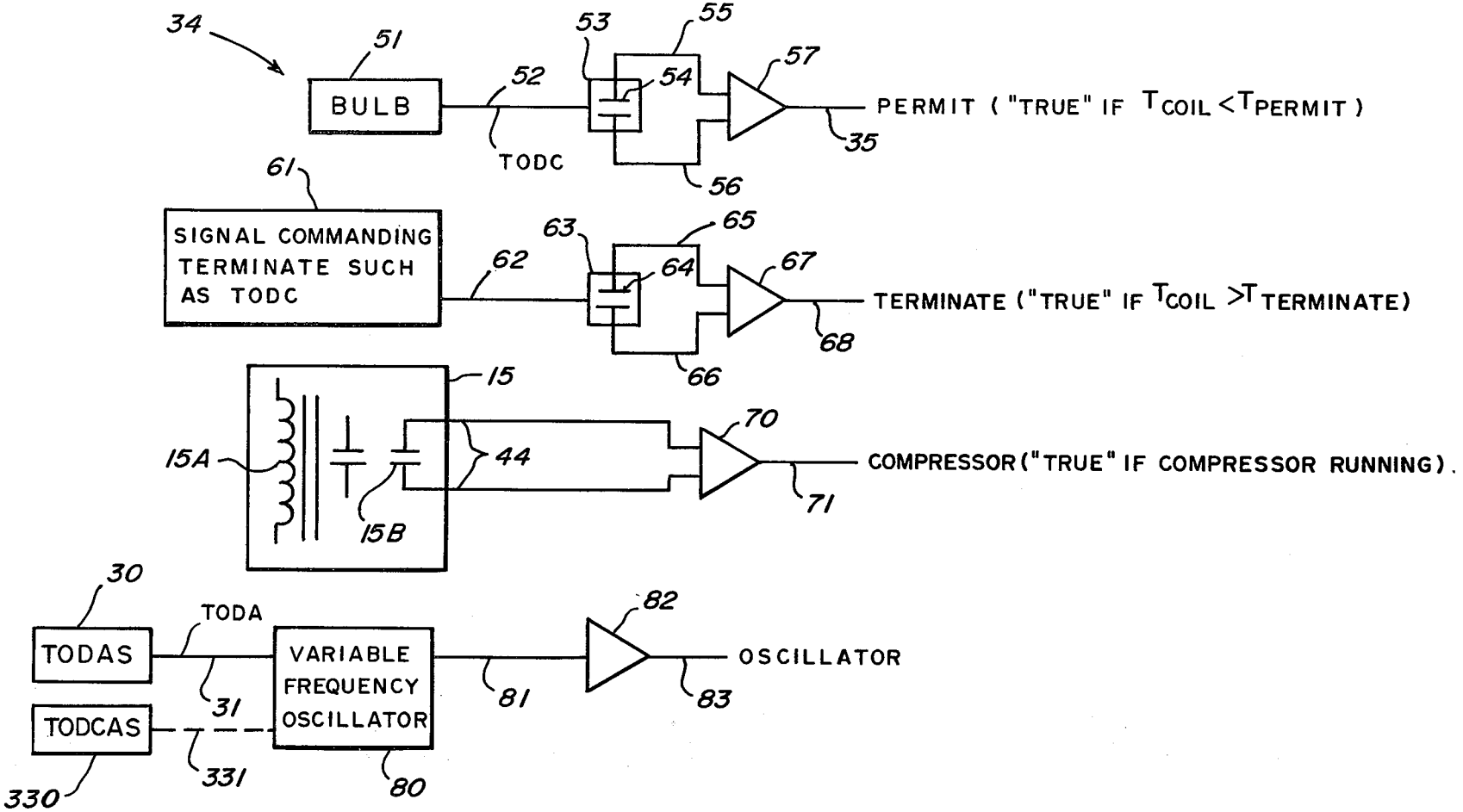
FIG. 2 depicts the signal sources for a counter circuit and controller depicted in FIG. 3.

Referring to FIG. 2 the outdoor coil temperature sensor TODCS 34 is shown in greater detail. More specifically the sensor 34 consists of a temperature sensing bulb 51 which is in thermal contact with the outdoor coil 12, said bulb 51 having a connection 52 to a controller means 53 and thence to a pair of electrical contacts 54 such that a change in the temperature of the outdoor coil 12 causes a corresponding change in the temperature of bulb 51 and a corresponding expansion of the fluid in bulb 51, said expansion being transmitted via connection 52 to controller 53 and thereby causing controller 53 to actuate electrical contacts 54 at a particular value of temperature of outdoor coil 12, hereinafter referred to as the "permit temperature;" such that the closure of electrical contacts 54 causes a current to flow through lines 55 and 56, said current causing amplifies 57 to apply an appropriate "permit" signal to connection 35 to indicate the conditions of outdoor coil 12, i.e. the outdoor coil having a temperature less than the "permit temperature," a representative value of "permit temperature" is 32° F. (0° C.).

Further in FIG. 2 a "terminate" signal is developed by a defrost termination means consisting of a defrost termination detection means 61 which provides a signal via connection 62 to controller 63 and thence to a pair of electrical contacts 64 such that the satisfaction of the criteria indicating the need to terminate the defrosting of outdoor coil 12 causes a corresponding signal to be generated at defrost termination detection means 61, said signal being transmitted via connector 62 to controller 63, whereby controller 63 actuates electrical contacts 64 and causes a current to flow through lines 65 and 66, said current causing amplifier 67 to apply an appropriate "terminate" signal to connection 68 to indicate the status of the defrost termination detection means, i.e. outdoor coil 12 being free of frost. Suitable means of detection of defrost termination comprise part of the prior art and are not part of the invention herein described.

Further in FIG. 2 the compressor controller 15 is depicted as including a coil 15A and a contact 15B which is closed whenever the compressor is energized. Closing of the contact 15B is communicated through leads 44 to a suitable amplifier 70 having an output 71 of a first or "true" sense if the compressor is running and of the opposite sense if the compressor is not running i.e. when contacts 15B are open.

At the bottom of FIG. 2 is depicted the outdoor air temperature sensor 30 supplying the TODA signal via connection 31 to a variable frequency oscillator 80 the output of which is applied via connection 81 to a suitable amplifier 82 having an output 83. As will be explained in greater detail below the output 83 is a signal the frequency of which varies on a non-linear basis according to the magnitude of the outdoor temperature TODA.

At the bottom of FIG. 2 is depicted an alternative to the connection of the outdoor air temperature sensor 30 supplying the TODA signal via connection 31 to a variable frequency oscillator 80, such alternative connection consisting of the outdoor coil temperature sensor TODCSA 330 supplying the TODCA signal via connector 331 to a variable frequency oscillator 80, the output of which is applied via connection 81 to a suitable amplifier 82 having an output 83. As will be explained in greater detail below, the output 83 is a signal, the frequency of which varies on a non-linear basis according to the magnitude of the outdoor coil temperature TODCA.

Figure 3:
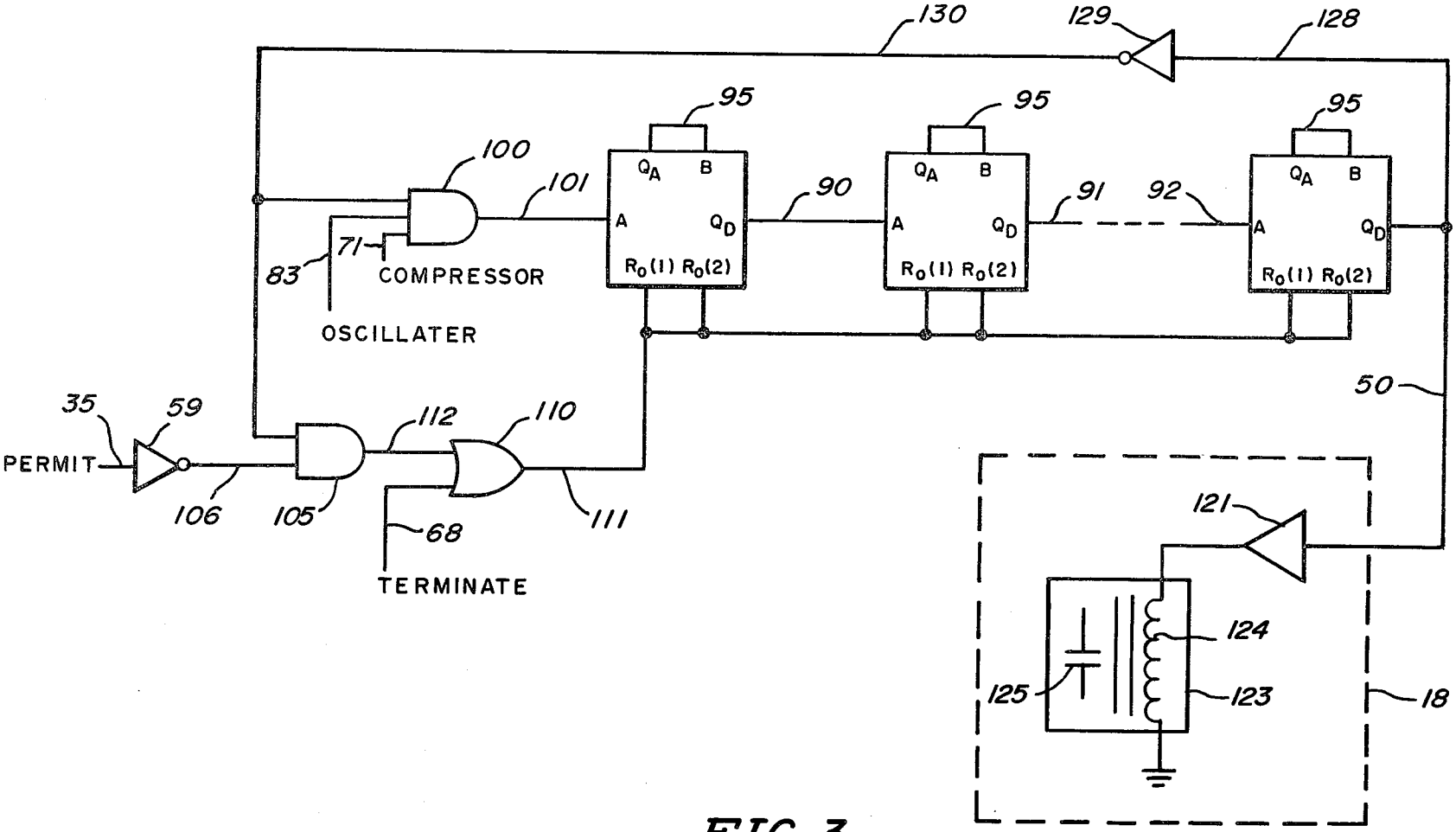

Referring to FIG. 3 the controller and counter depicted therein comprises in part a plurality of four bit binary counters which may be type SN7493N manufactured by Texas Instruments, Inc. and others, connected in cascade. As is understood by those skilled in the art each counter produces an output on terminal $Q_D$ at 1/16 the frequency of the input applied to the terminal A thereof. By connecting the output of a counter to the input of the following counter, then the output of the second or the following counter is at 1/16 the frequency of the output of the first one or 1/256 the frequency of the first counter's input. This cascading technique may be used to convert an oscillator with a frequency of several kilohertz or megahertz to a signal with a period of several hours. Thus in FIG. 3 counter C1, C2 and CN are depicted each having several terminals, six of which are shown: A, QA, B, QD, Ro(1), Ro(2). Other terminals are omitted for clarity. The terminal QD of counter C1 is connected via 90 to terminal A of counter C2 and terminal QD of counter C2 is connected via 91 to successive stages of counters until eventually an input 92 is applied to the final four bit counter CN. In all cases the terminals QA and B are interconnected as at 95.

The output of oscillator 80 is applied via 83, a gate 100 and a connection 101 to terminal A of counter C1 whenever gate 100 is enabled, this being controlled by a first input which is the output 71 from the compressor running detector means depicted in FIG. 2 and by a second input which is the output 130 of inverter 129, said gate 100 causing the output signal on connector 101 to have a frequency signal to the frequency of the signal of the oscillator whenever both said first input and said second input are in the logical "true" state. Inverter 129 in turn receives an input via connection 128 from the output of counter CN such that the output of inverter 129 is the logical negation of the output of counter CN. Thus the output from oscillator 80 is permitted to flow via 83 and through the gate 100 so as to be counted by the counting means when both a compressor running signal is present at the output 71 of amplifier 70 and the last output 128 on the QD terminal of counter CN is a logical "false," i.e. the compressor is running and the counter has not counted a sufficient number of cycles to indicate a need for defrosting.

Each stage $C_1$, $C_2$ . . . CN of the counter has two reset terminals $R_0$(1) and $R_0$(2) which, upon the input signal on connection 111 being a logical "true" state causes the counter to reset to its initial state, said input signal being a logical "true" when either (1) a defrost terminate signal is detected as a logical "true" signal on connection 68 from amplifier 67, depicted on FIG. 2, or (2) both inputs of gate 105 are in the logical "true" state, corresponding to the outputs on connection 130 from inverter 129 and the output on connection 106 from inverter 59. The signal on connection 68 is a logical "true" whenever the conditions are proper to terminate defrosting of the outdoor coil. The signal on connection 106 is a logical "true" when the output of inverter 59 is true, the output of inverter 59 being the logical negation of the signal on connection 35 which is the output of amplifier 57, i.e. the signal on connection 35 is a logical "true" whenever TODC is less than the "permit temperature," i.e. the output of inverter 59 is a logical "true" when TODC is greater than the "permit temperature."

The output terminal QD of the final stage CN of the counter means is connected through a connecting lead 50 (see also FIG. 1) to the control 18 of the reversing valve 16 of the heat pump system. In FIG. 3 within block 18 is depicted an amplifier 121 receiving the output from counter unit CN: the output of the amplifier 121 is shown to be connected to a contactor unit 123 comprising a coil 124 connected at one end to amplifier 121 and to ground at the other end and adapted when energized to actuate contacts 125 which are symbolic of means for actuating the reversing valve 16.

The counter and controller depicted in FIG. 3 operate to accumulate a count of cycles of oscillator 80 under conditions of frost accumulation on outdoor coil 12. The conditions for accumulation of a count of said cycles are: (1) the compressor 14 is operating, (2) the heat pump is not defrosting (3) a signal to reset the counter is not present. A signal to reset the counter is present under one of the following conditions: (1) the heat pump is not defrosting and TODC is not less than the "permit temperature," or (2) the heat pump is defrosting and the conditions for termination of defrosting are satisfied.

Figure 5:
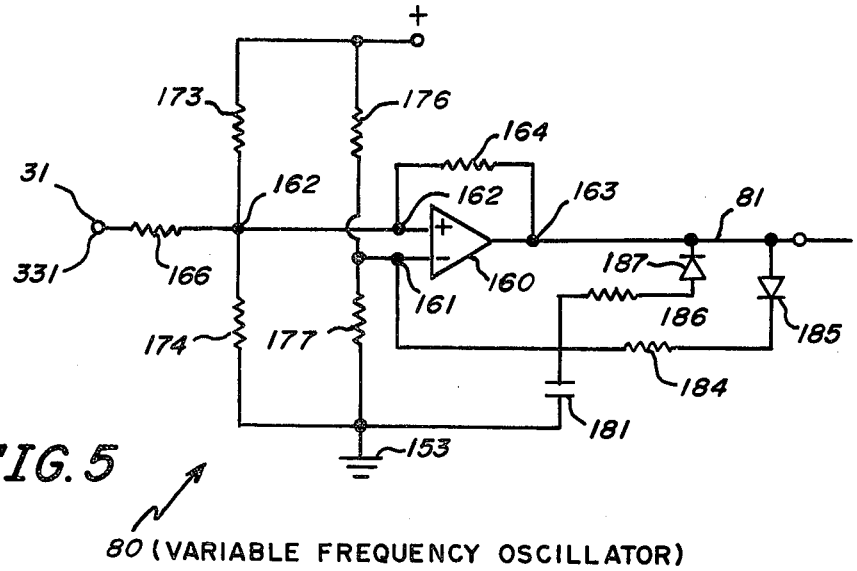
FIG. 5 is a detailed schematic diagram of the variable frequency oscillator utilized in the control systems.

Referring to FIG. 5, the variable frequency oscillator 80 is shown in greater detail. The outdoor temperature sensor (TODAS) 30 is depicted as having an output signal TODA on connection 31 which provides a linearly varying voltage with outdoor air temperature. Alternatively, the outdoor coil temperature sensor TODCS 330 is depicted as having an output signal TODCA on connection 331 which provides a linearly varying voltage with outdoor coil temperature.

The oscillator 80 further comprises an operational amplifier 160 having non-inverting terminal 162 and an inverting terminal 161 as well as an output 163. A positive feedback resistor 164 is connected between 163 and 162; and the output TODAS 30 is applied to the non-inverting terminal 162 of operational amplifier 160 through a resistor network 166, 173 and 174. A resistor 176 is connected between terminal 170 and input terminal 161 of amplifier 160 and yet another resistor 177 is connected between 161 and ground 153. A capacitor 181 is connected between terminal 161 and ground 153. A resistor 184 and a diode 185 are connected in series between output lead 81 of the oscillator and junction point 161 and an oppositely poled diode 187 and a resistor 186 are also connected between lead or output 81 and junction point 161. Resistors 184 and 186, diodes 185 and 187 and capacitor 181 comprise a negative feedback network for amplifier 160.

The operation of the oscillator 80 is based upon the use of the operational amplifier 160 as a voltage comparator. The input terminals 161 and 162 have a high impedance. When the voltage at the non-inverting terminal 162 exceeds the voltage at the inverting terminal 161 then the voltage at the output 163 or 81 goes to the level of the supply voltage 170. When the voltage at the negative terminal 161 exceeds the voltage at the positive terminal 162 then the output voltage at 81 goes to zero. The circuit is caused to oscillate by establishing switch points on the positive terminal 162 and then charging and discharging the capacitor of 181 to sweep the negative terminal 161 voltage back and forth past the switch points. To further describe the operation of the oscillator, it may be assumed that the device is in operation and then the events which occur may be described by selecting a starting point and then noting the events which sequentially occur to return to the same starting point. Arbitrarily the selected starting condition is just before the output switches from low to high. In this condition the "low reference point" is established on the non-inverting terminal 162 as determined by nodal analysis for resistors 173, 174 and 164 and the voltage at node 163 at zero volts. Because the output voltage at 163 is low and is about to switch high, the negative terminal voltage at 161 is slightly above the low reference point. Capacitor 181 is discharging through resistor 186 and zener diode 187 which causes the negative terminal voltage to drop. When capacitor 181 discharges such that the inverting terminal voltage 161 is less than the non-inverting terminal voltage at 162 then the output voltage at 163 swings high i.e. to the level of the supply voltage at 170. Because the voltage across capacitor 181 does not change instanteously then the voltage at the inverting terminal 161 remains unchanged but the voltage at the non-inverting terminal is increased due to the contribution of the increased voltage at node 163 to the voltage at node 162. The capacitor 181 then begins charging through diode 185 and resistor 184 thus raising the voltage at the inverting terminal 161 until it reaches the high reference voltage when the inverting terminal voltage exceeds the non-inverting terminal voltage, output voltage at node 163 goes low and capacitor 181 discharges through resistor 186 and diode 187 for it to return to the starting point.

Capacitor 181 charges and discharges at an exponential rate; because of this the rate of charging and discharging about the low and high switch point varies depending upon the average of the two switch points (assuming the difference in the switch point is constant). Oscillator 80 is designed so that the frequency of oscillation will peak or be at a maximum at a preselected value of outdoor air temperature and drop off at values either greater or lesser than such value. This is depicted in FIG. 6 where the reference numerical 190 is used to identify a graph of oscillator frequency plotted as a function of outdoor air temperature.

As indicated oscillator 80 has a maximum frequency at an input thereto which corresponds to a preselected outdoor air temperature; such temperature is selected to be that which had been predetermined to require a maximum number of daily defrost cycles of the heat pump system (when operated in the heating mode).

Figure 6:
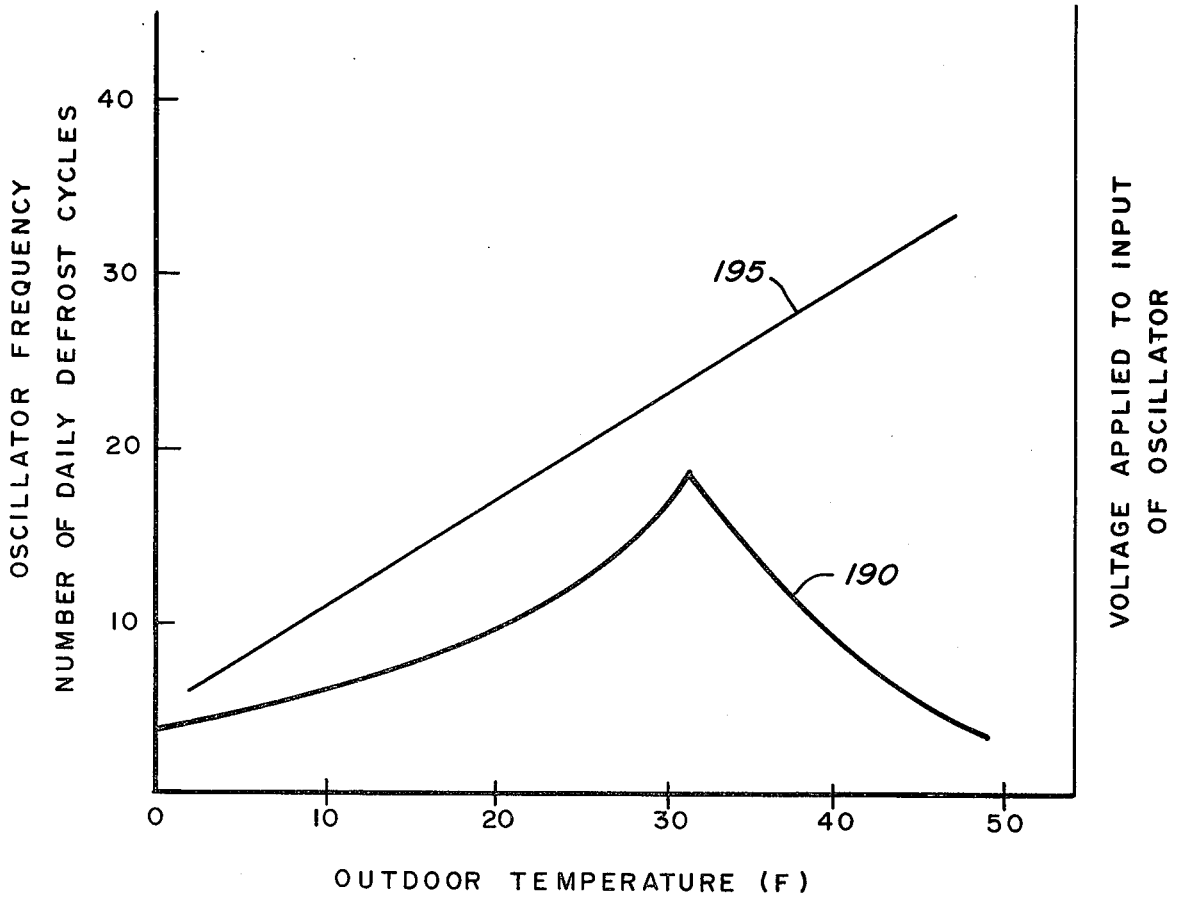
FIG. 6 is a graph showing three functions which vary according to the magnitude of outdoor air temperature more specifically: (1) the number of daily defrost cycles required for a typical heat pump, (2) the variation of the frequency of the oscillator, and (3) the voltage applied to the input of the oscillator.

Also in FIG. 6 reference numeral 195 identifies a plot of the voltage applied to the input of amplifier 160 of oscillator 80 (see FIG. 5) as a function of the magnitude of outdoor air temperature. Thus graph 190 of FIG. 6 is also representative as the number of daily defrost cycles, i.e., a preselected schedule of defrost cycles of the heat pump system when used in the heating mode.

The rate of change in frequency of the oscillator can be adjusted by varying the charging of the capacitor and discharging of the capacitor by adjusting the values of resistors 184 and 186.

It thus follows that the variable frequency oscillator 80 will have a maximum frequency of oscillation at a preselected value of outdoor air temperature, preferably approximately 32 degrees Fahrenheit or alternatively at a preselected value of outdoor coil temperature corresponding to an outdoor air temperature of 32 degrees Fahrenheit, typically 22 degrees Fahrenheit, and as the outdoor air temperature or alternatively outdoor coil temperature deviates from said preselected value the frequency of the oscillator will decrease as depicted in FIG. 6.

Figure 7:
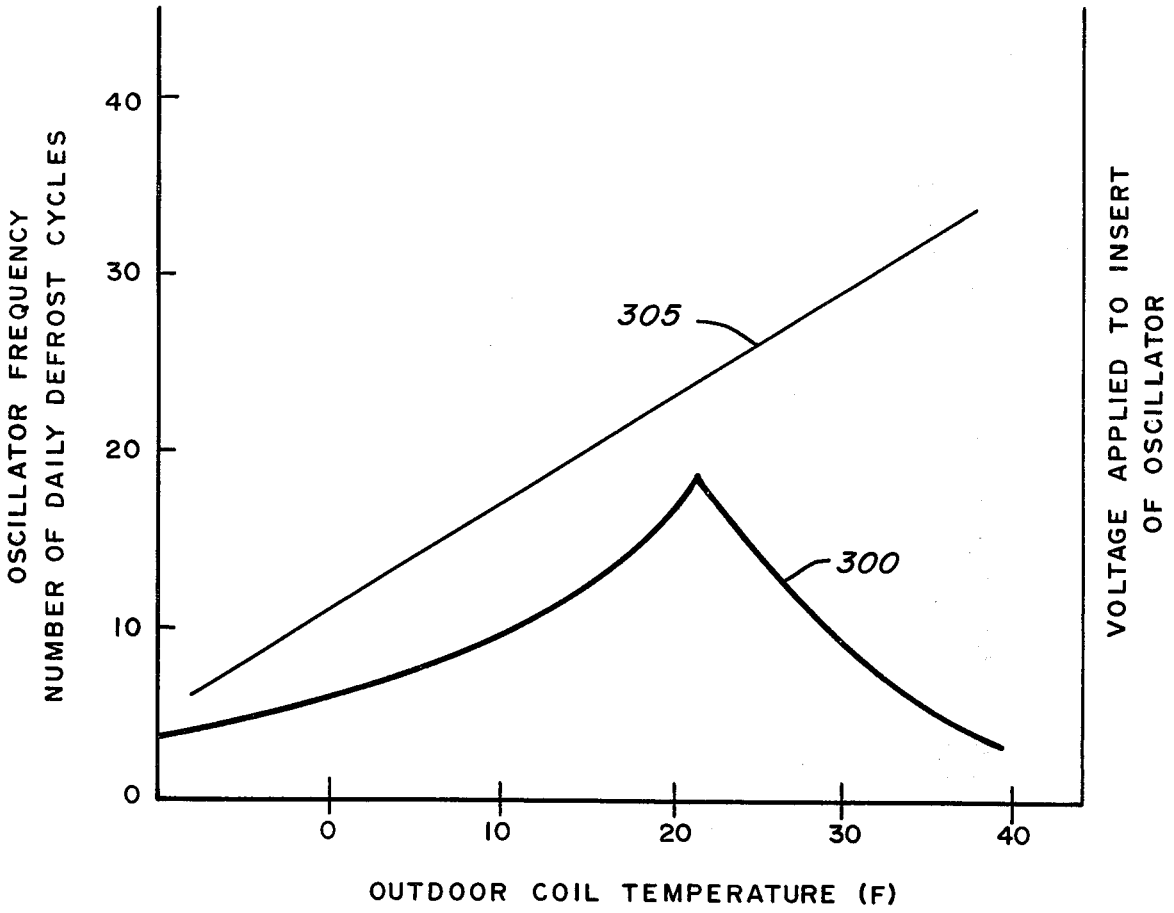
FIG. 7 is a graph showing three functions which vary according to the magnitude of outdoor coil temperature, more specifically: (1) the number of daily defrost cycles required for a typical heat pump, (2) the variation of the frequency of the oscillator, and (3) the voltage applied to the input of the oscillator.

Referring to FIG. 7, it will be noted that a graph 300 depicts the variation between the number of daily defrost cycles and outdoor coil temperatures; it will be observed that the peak defrost requirement occurs at about 22° F. In FIG. 7, the reference numeral 305 designates the voltage applied to the input of the oscillator, and graph 300 is also representative of the desired frequency output of the oscillator as a function of outdoor coil temperature.

Figure 4:
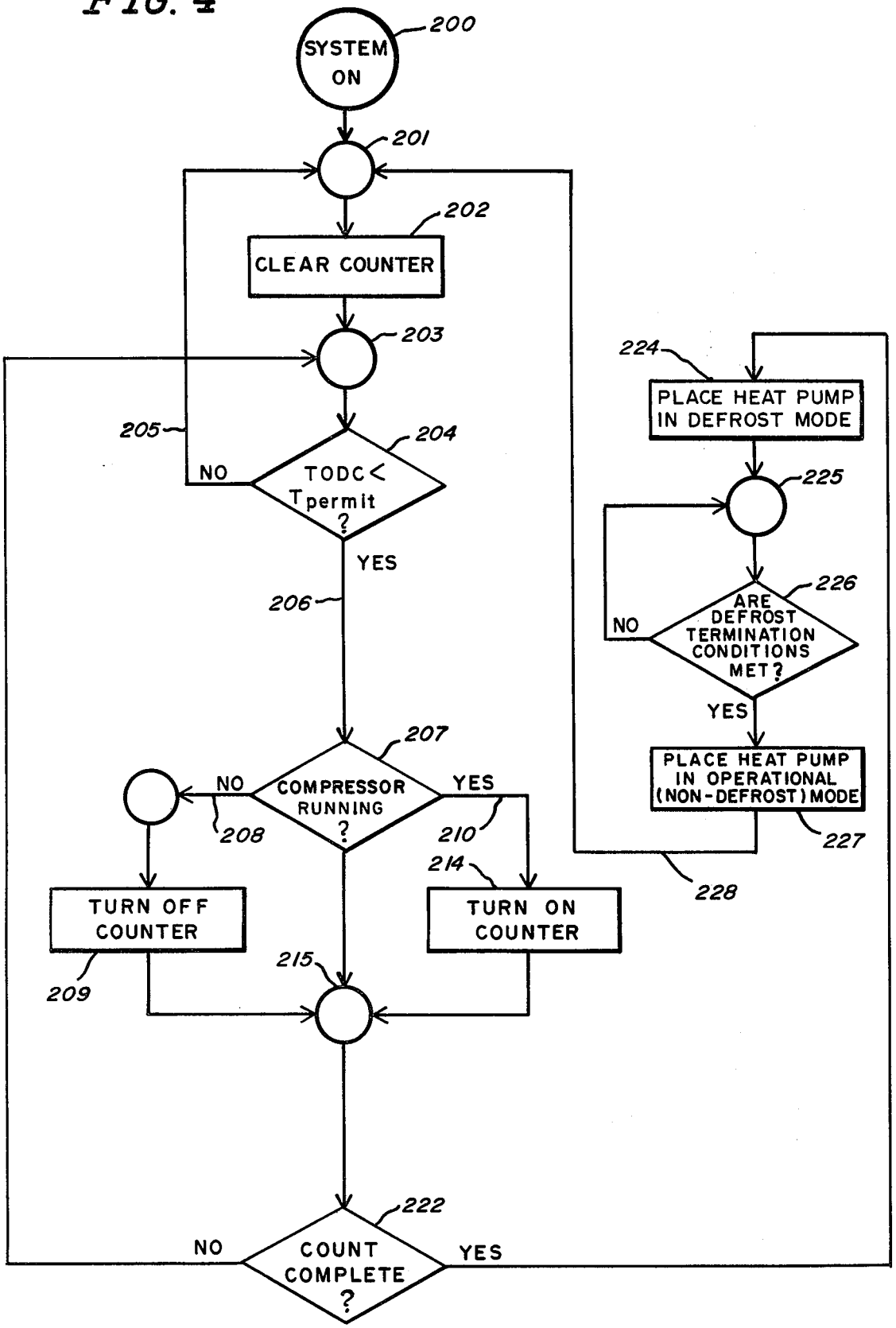
FIG. 4 is a flow chart for the control system.

Referring now to FIG. 4 a flow chart for the apparatus described above is shown. The reference numeral 200 identifies a "system on" entry point flowing into a junction 201 which flows to an instruction block 202 "clear counter" the flow from which is through a junction 203 to a logic instruction block 204 "TODC is less than Tpermit?" having a "no" response 205 connected to junction 201 and a "yes" response 206 connected to logic instruction block 207 "compressor running?" having a "no" response 208 connected to an operation or instruction block 209 "turn off counter," and a "yes" response 210 connected to an operational instruction block 214 "turn on counter" flow from which is applied to a junction 215 which also receives the flow from instruction block 209; flow from junction 215 is to a logic instruction block 222 "count complete?" having a "no" response connected to junction 203 and a "yes" response connected to another operation or instruction block 224 "place heat pump in defrost mode" flow from which is to a junction 225 and thence to a logic instruction block 226 "are defrost termination conditions met?" having a "no" response connected to junction 225 and a "yes" response connected to an operational instruction block 227 "place heat pump in operational (non defrost) mode" flow from which is applied via 228 to the junction 201.

Thus with reference to all Figures it will be understood that in the operation of the described apparatus if the Counter C1, C2 . . . CN has not completed a predetermined number of counts corresponding to a blocked coil condition and compressor 14 is operating then appropriate signals will be applied at 130 and 71 to gate 100 to thus permit the output from the oscillator 80 at 83 to be applied through gate 100 to the counter apparatus C1, C2 . . . CN. The preceding is also represented in the flow chart of FIG. 4 by logic instructions 204 and 212 so that if TODC is less than Tpermit and the compressor is running then the counter will be turned on as is depicted by instruction block 214. It will be understood that if at any time the outdoor coil temperature exceeds the preselected Tpermit then this is indicative of the outdoor coil temperature being so high that ice or frost would not form thereon and therefore it is not necessary to be concerned about defrost, an output will be applied at 35 from amplifier 57 (see FIG. 2) to the input to gate 59 (see FIG. 3) and to thus reset the counters.

It will be further understood from the preceding description, that the non-linear relationship between TODA and the output frequency of oscillator 80 is specifically tailored to the preselected relationship between TODA and the number of daily defrost cycles required for a neat pump system to obtain optimum performance. Thus, as TODA varies, the output frequency of oscillator 80 varies as shown in FIG. 6 to cause either an increase or decrease in the frequency of the defrost cycle.

Also, in the alternate embodiment, the non-linear relationship between TODCA and the output frequency of oscillator 80 is specifically tailored to the preselected relationship between TODCA and the number of daily defrost cycles required for a heat pump system to obtain optimum performance. Thus, as TODCA varies, the output frequency of oscillator 80 varies as shown for a typical heat pump in FIG. 7 to cause either an increase or decrease in the frequency of the defrost cycle.

Representative values of the components used in the variable frequency oscillator 80 shown in FIG. 5 are as follows:

160—Operational Amplifier, Texas Instrument Model μA798
164—95.3K ohm
166—10K ohm
173—20K ohm
174—20K ohm
176—6.64K ohm
177—20K ohm
181—10 μF
184—32.4K ohm
185—1N4001
186—0.475K ohm
187—1N4001

While we have described a preferred embodiment of this invention, it will be understood that the invention is limited only by the scope of the following claims.

We claim:

1. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

first outdoor coil temperature sensing means (hereinafter "TODCSA") having an output indicative of outdoor air temperature (hereinafter "TODCA");

second outdoor coil temperature sensing means (hereinafter "TODCS") having an output indicative of the temperature of said outdoor coil (hereinafter "TODC");

means (hereinafter "COM") operatively associated with said compression means and adapted to have an output indicative of the operation of said compression means; and controller means having operative connections to said TODSCA, TODCS, and COM so as to receive the outputs thereof, said controller having a TODCA monitoring function which is initiated upon (i) TODC being at or below a preselected value and (ii) said compression means being operated, said controller means further comprising (1) a variable frequency electronic oscillator having an input connected to TODCSA by means so as to receive a signal indicative of TODCA and an output signal the frequency of which is maximum at a preselected value of TODCA and continuously decreases as the value of TODCA deviates either above or below said preselected value; (2) a counter means having an input connected to receive the output signal of said variable frequency oscillator; and (3) means for connecting said counter means to said system, and being adapted, upon said counter means counting a preselected number of pulses, to place said system into an outdoor coil defrost mode of operation.

2. Apparatus of claim 1 further characterized by means connecting TODCS to said counter means and for causing said counter means to be reset upon TODC being at or above a preselected value.

3. Apparatus of claim 1 further characterized by said oscillator output frequency being substantially matched, as a function of TODCA, to a preselected schedule of defrost cycles of said system.

* * * * *